US008360475B2

(12) United States Patent
Cristiano

(10) Patent No.: US 8,360,475 B2
(45) Date of Patent: Jan. 29, 2013

(54) ROLLER SKIS OR BOARDS

(75) Inventor: Orlandi Cristiano, Subiaco (IT)

(73) Assignee: Bolditalia S.R.L., Subiaco (IT)

( * ) Notice: Subject to any disclaimer, the term of this patent is extended or adjusted under 35 U.S.C. 154(b) by 0 days.

(21) Appl. No.: 13/312,265

(22) Filed: Dec. 6, 2011

(65) Prior Publication Data

US 2012/0104708 A1 May 3, 2012

Related U.S. Application Data

(63) Continuation of application No. PCT/IT2010/000256, filed on Jun. 8, 2010.

(30) Foreign Application Priority Data

Jun. 8, 2009 (IT) ..... RM2009A0287

(51) Int. Cl.

| | |
|---|---|
| ***A63C 1/00*** | (2006.01) |
| ***A63C 17/04*** | (2006.01) |
| ***A63C 17/02*** | (2006.01) |
| ***A63C 17/00*** | (2006.01) |
| ***A63C 1/24*** | (2006.01) |

(52) U.S. Cl. ..... 280/842; 280/11.232; 280/11.221; 280/11.222; 280/11.19; 280/11.28

(58) Field of Classification Search ..... 280/11.232, 280/11.233, 11.12, 11.19, 600, 842, 11.204, 280/11.209, 11.221, 11.222, 11.28
See application file for complete search history.

(56) References Cited

U.S. PATENT DOCUMENTS

| | | | | |
|---|---|---|---|---|
| 244,372 A | | 7/1881 | Bliss | |
| 565,718 A | | 8/1896 | Boardman | |
| 1,269,107 A | | 6/1918 | Moomaw | |
| 1,467,453 A | | 9/1923 | Remacle | |
| 1,809,609 A | | 6/1931 | Turner | |
| 2,097,721 A | * | 11/1937 | Cledina | 280/11.201 |
| 2,114,586 A | | 4/1938 | Bowen | |
| 2,424,072 A | | 7/1947 | Allred | |
| 2,542,829 A | | 2/1951 | Murray | |

(Continued)

FOREIGN PATENT DOCUMENTS

| | | |
|---|---|---|
| DE | 29518632 | 1/1996 |
| DE | 29611481 | 11/1996 |

(Continued)

OTHER PUBLICATIONS

International Search Report issued in connection with International Application No. PCT/IT2010/000256, 4 pages.

(Continued)

*Primary Examiner* — J. Allen Shriver, II
*Assistant Examiner* — James M Dolak
(74) *Attorney, Agent, or Firm* — Gesmer Updergrove LLP

(57) ABSTRACT

The present invention relates to a roller ski or board, said ski or board providing in-line central rollers, centrally provided on the ski or board body, and two pairs of additional rollers, respectively a front pair and a rear pair, said pair of rollers being raised with respect to the ground on which ski or board rests when the same ski or board is substantially parallel with respect to the ground, and contacting the same ground when ski or board is inclined, each one of the additional rollers is coupled with the ski or board by a support system comprising a fork, having one end coupled with the roller and the other one faced toward the ski or board, between the end of the fork faced toward the ski or board and the same ski or board being provided with a resilient element.

8 Claims, 15 Drawing Sheets

U.S. PATENT DOCUMENTS

| | | | | | |
|---|---|---|---|---|---|
| 2,632,652 | A | | 3/1953 | Wintercorn | |
| 3,235,282 | A | | 2/1966 | Bostick | |
| 3,365,208 | A | * | 1/1968 | Blanchard | 280/842 |
| 3,389,922 | A | * | 6/1968 | Eastin | 280/842 |
| 3,442,528 | A | | 5/1969 | Rademacher | |
| 3,505,878 | A | | 4/1970 | Moll | |
| 3,649,038 | A | | 3/1972 | Huckenbeck | |
| 3,749,413 | A | * | 7/1973 | Nicolson | 280/842 |
| 3,771,811 | A | | 11/1973 | Bueno | |
| 3,926,449 | A | * | 12/1975 | Wilje | 280/842 |
| 4,061,350 | A | | 12/1977 | Schmidt, Jr. et al. | |
| 4,071,256 | A | | 1/1978 | Kimmell | |
| 4,076,265 | A | | 2/1978 | Eash, II | |
| 4,109,925 | A | | 8/1978 | Williams et al. | |
| 4,114,232 | A | | 9/1978 | Umeda | |
| 4,159,830 | A | | 7/1979 | Solimine | |
| 4,166,629 | A | | 9/1979 | List | |
| 4,168,842 | A | | 9/1979 | Kimmell et al. | |
| 4,176,850 | A | | 12/1979 | Johnson | |
| 4,202,558 | A | | 5/1980 | Olschewski et al. | |
| 4,202,559 | A | | 5/1980 | Piazza, Jr. | |
| 4,645,223 | A | | 2/1987 | Grossman | |
| 4,775,162 | A | | 10/1988 | Chao | |
| 4,776,604 | A | | 10/1988 | Valdez et al. | |
| 4,836,567 | A | | 6/1989 | Schmid | |
| 4,930,794 | A | | 6/1990 | Chan | |
| 4,955,626 | A | | 9/1990 | Smith et al. | |
| 5,029,887 | A | | 7/1991 | Grutzner et al. | |
| 5,052,702 | A | | 10/1991 | Chan | |
| 5,195,781 | A | | 3/1993 | Osawa | |
| 5,236,208 | A | | 8/1993 | Welsh | |
| 5,263,725 | A | | 11/1993 | Gesmer et al. | |
| 5,292,141 | A | | 3/1994 | Ekedal et al. | |
| 5,347,681 | A | | 9/1994 | Wattron et al. | |
| 5,372,384 | A | | 12/1994 | Smith | |
| 5,409,265 | A | | 4/1995 | Douglass | |
| 5,505,474 | A | | 4/1996 | Yeh | |
| 5,522,620 | A | | 6/1996 | Pracas | |
| 5,540,455 | A | | 7/1996 | Chambers | |
| 5,613,695 | A | | 3/1997 | Yu | |
| 5,833,252 | A | | 11/1998 | Strand | |
| 5,855,385 | A | | 1/1999 | Hambsch | |
| 5,868,408 | A | | 2/1999 | Miller | |
| 5,879,013 | A | | 3/1999 | Shih | |
| 5,915,707 | A | | 6/1999 | Steffen | |
| 5,975,546 | A | | 11/1999 | Strand | |
| 5,992,865 | A | | 11/1999 | Vargas | |
| 5,997,018 | A | * | 12/1999 | Lee | 280/87.042 |
| 6,105,978 | A | | 8/2000 | Vuerchoz | |
| 6,193,249 | B1 | | 2/2001 | Buscaglia | |
| 6,206,389 | B1 | | 3/2001 | Yagi | |
| 6,237,960 | B1 | | 5/2001 | Dornhofer | |
| 6,257,614 | B1 | | 7/2001 | Duggan | |
| 6,267,394 | B1 | | 7/2001 | Bouden | |
| 6,270,096 | B1 | | 8/2001 | Cook | |
| 6,298,952 | B1 | | 10/2001 | Tsai | |
| 6,318,739 | B1 | | 11/2001 | Fehn, Jr. | |
| 6,398,237 | B1 | * | 6/2002 | Attey | 280/87.042 |
| 6,398,238 | B1 | | 6/2002 | Shaw | |
| 6,419,249 | B1 | | 7/2002 | Chen | |
| 6,428,022 | B1 | | 8/2002 | Namiki | |
| 6,428,023 | B2 | | 8/2002 | Reyes et al. | |
| 6,435,558 | B2 | | 8/2002 | Osawa | |
| 6,467,782 | B1 | | 10/2002 | Smith | |
| 6,488,295 | B1 | | 12/2002 | Bryant | |
| 6,547,262 | B1 | | 4/2003 | Yamada et al. | |
| 6,592,129 | B1 | * | 7/2003 | Gates | 280/11.204 |
| 6,793,224 | B2 | | 9/2004 | Stratton | |
| 6,926,294 | B2 | * | 8/2005 | Lewis | 280/87.042 |
| 7,000,930 | B2 | * | 2/2006 | Smith | 280/87.021 |
| 7,080,845 | B2 | | 7/2006 | Inchley | |
| 7,121,566 | B2 | | 10/2006 | McClain | |
| 7,195,259 | B2 | | 3/2007 | Gang | |
| 7,213,823 | B1 | * | 5/2007 | Vujtech | 280/87.021 |
| 7,237,784 | B1 | | 7/2007 | Monteleone | |
| 7,243,925 | B2 | | 7/2007 | Lukoszek | |
| 7,287,762 | B2 | | 10/2007 | Stratton | |
| 7,438,303 | B2 | | 10/2008 | Cole | |
| 7,464,951 | B2 | | 12/2008 | Coray | |
| 7,600,768 | B2 | | 10/2009 | Chen et al. | |
| 7,766,351 | B2 | | 8/2010 | Chen et al. | |
| 7,775,534 | B2 | | 8/2010 | Chen et al. | |
| 7,784,833 | B2 | | 8/2010 | Tsuchie | |
| 7,891,680 | B2 | | 2/2011 | Chen et al. | |
| 2002/0067015 | A1 | | 6/2002 | Tierney et al. | |
| 2002/0084602 | A1 | | 7/2002 | Feng | |
| 2002/0163144 | A1 | | 11/2002 | Guerra | |
| 2003/0098555 | A1 | | 5/2003 | Chen | |
| 2004/0239065 | A1 | | 12/2004 | Smith | |
| 2005/0127629 | A1 | | 6/2005 | Nelson et al. | |
| 2007/0114743 | A1 | | 5/2007 | Chen | |
| 2008/0030014 | A1 | * | 2/2008 | Pate et al. | 280/842 |
| 2008/0284121 | A1 | * | 11/2008 | French | 280/87.042 |
| 2009/0045598 | A1 | | 2/2009 | Lee | |
| 2009/0250891 | A1 | | 10/2009 | Stratton | |

FOREIGN PATENT DOCUMENTS

| | | | |
|---|---|---|---|
| DE | 19710626 | A1 | 1/1998 |
| EP | 557872 | A1 | 9/1993 |
| FR | 2660205 | A1 | 10/1991 |
| GB | 2186501 | | 8/1987 |
| GB | 2465692 | A | 6/2010 |
| WO | WO2004/014499 | | 2/2004 |
| WO | 2004020059 | A1 | 3/2004 |
| WO | 2004037358 | A1 | 5/2004 |
| WO | WO2007117125 | | 10/2007 |
| WO | WO2010019627 | | 2/2010 |

OTHER PUBLICATIONS

"Quad Roller Skate Trucks" <http://www.quadskating.com/skates/roller-skate-trucks.htm>.

"Skateboard Trucks" <http://www.skatesonhaight.com/ProductDetails.asp?ProductCode=TTRTX>.

International Search Report and Written Opinion issued on Nov. 26, 2010 in connection with International Application PCT/IT2010/000256, 8 pages.

International Preliminary Report on Patentability issued on Dec. 12, 2011 in connection with International Application PCT/IT2010/000256, 5 pages.

* cited by examiner

ROLLER SKIS OR BOARDS

PRIORITY

The present application is a continuation of PCT/IT2010/000256 filed on 8 Jun. 2010, which claims priority to Italian Patent Application No. RM2009A000287 filed on 8 Jun. 2009, each of which is hereby incorporated by reference in its entirety.

The present invention relates to an improvement in roller ski or boards.

More specifically, the invention concerns a solution relevant to the dampening system of rollers of roller ski or boards.

As it is well known, different solutions have been suggested recently about the realisation of roller ski, i.e. ski or boards permitting skiing along slopes without snow, such as lawns and like.

Different patents exist describing this kind of solutions, such as U.S. Pat. Nos. 4,836,567, 6,237,960, 6,435,558, 5,855,385 and 5,195,781.

Recently, European patent no 1 556 146 has been filed (Oct. 28, 2002) and granted (May 24, 2006) in the name of Cristiano Orlandi, concerning a roller ski or board permitting overcoming the problems of known solutions, with particular reference to stability and "skiing" of the ski with every condition.

Particularly, the solution suggested in the above European patent provides, in a roller ski or board comprising in-line central support rollers and a plurality of additional front and rear rollers, raised with respect to the ground when the ski or board are (is) parallel with respect to the ground and that can alternatively rest on the ground when the ski or board are (is) tilted, mounting of the additional rollers on the ski or board occurring by a bearing.

The solution suggested in the above European patent is a first response to the problems of the available technology. However, still remains the needing of further improving the coupling between the additional rollers and the ski or board, in order to permit a better skiing under every situation.

In this context it is included the solution according to the present invention, permitting having a system for coupling additional rollers and the ski or board permitting easing the optimum skiing both along very steep slopes and for heavy skiers, or under maximum speed and lateral inclination conditions.

It is therefore specific object of the present invention a roller ski or board, said ski or board providing in-line central rollers, centrally provided on the ski or board body, and two pairs of additional rollers, respectively a front pair and a rear pair, said pair of rollers being raised with respect to the ground on which ski or board rests when the same ski or board is substantially parallel with respect to the ground, and contacting the same ground when ski or board is inclined, each one of the additional rollers is coupled with the ski or board by a support system comprising a fork, having one end coupled with the roller and the other one faced toward the ski or board, between the end of the fork faced toward the ski or board and the same ski or board being provided a resilient element.

According to the invention, it is provided a sheets system for fixing said resilient element on the ski or board.

Furthermore, according to the invention, said resilient element is provided between the end of the fork faced toward the ski or board and the same ski or board.

Still according to the invention, ski or board and forks are realized integrally in a single piece, said resilient element being comprised of a specific material provided in the joining portion between ski or board and forks.

Preferably, according to the invention, means are provided on said resilient element for adjustment of hardness and inclination.

Particularly, according to the invention, said resilient element can be comprised of a rubber element, of an elastomeric element, or of a spring.

Always according to the invention, said sheets system for fixing the resilient element to the ski or board can provide a shaped sheet so as to operate as joint between the flat surface of the ski or board and the coupling angle of the fork.

The present invention will be described, for illustrative but not imitative purposes, according to its preferred embodiments, with particular reference to the enclosed drawings, wherein.

Figure 1:
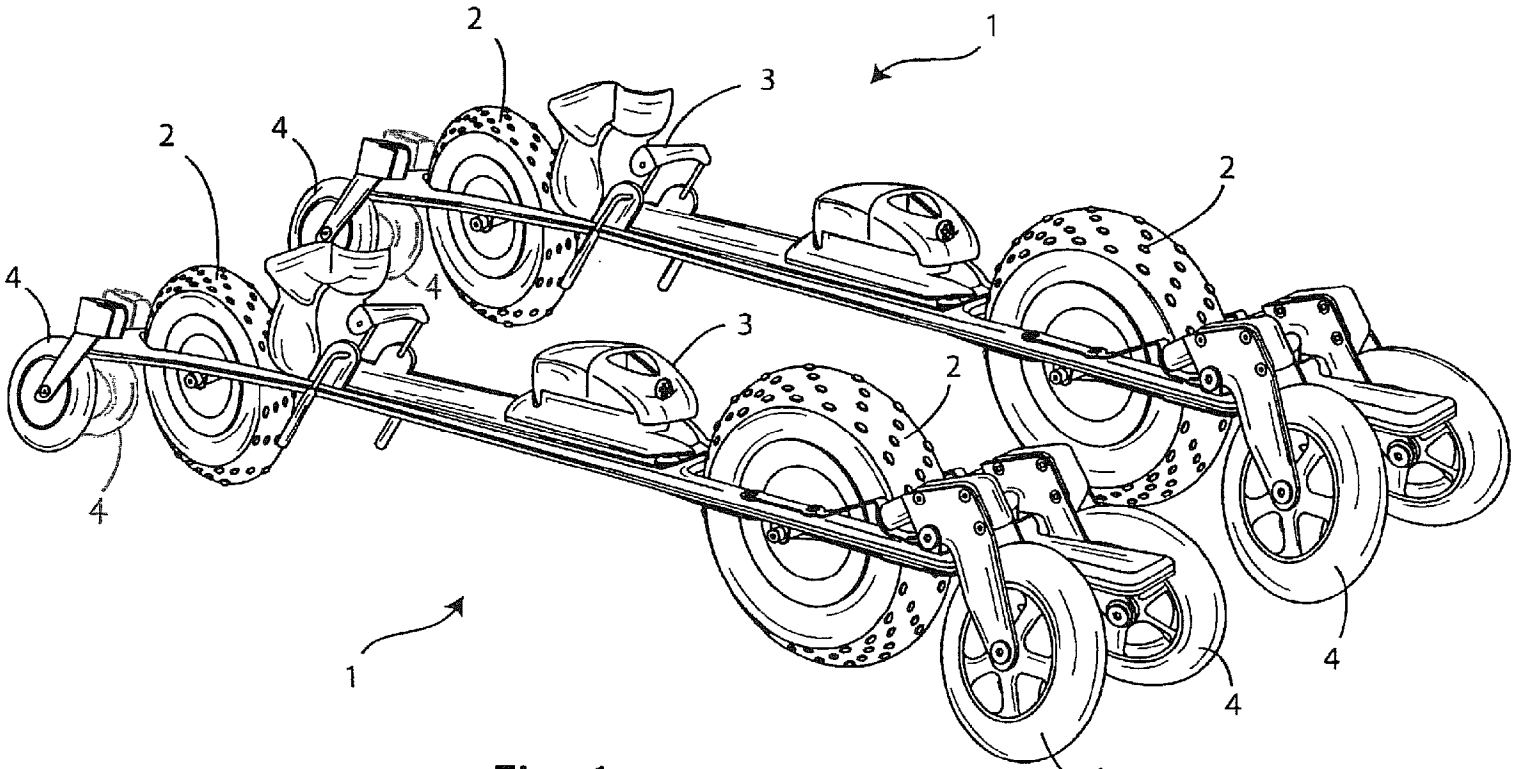
FIG. 1 is a perspective view of a first embodiment of skis according to the invention.
Figure 2:
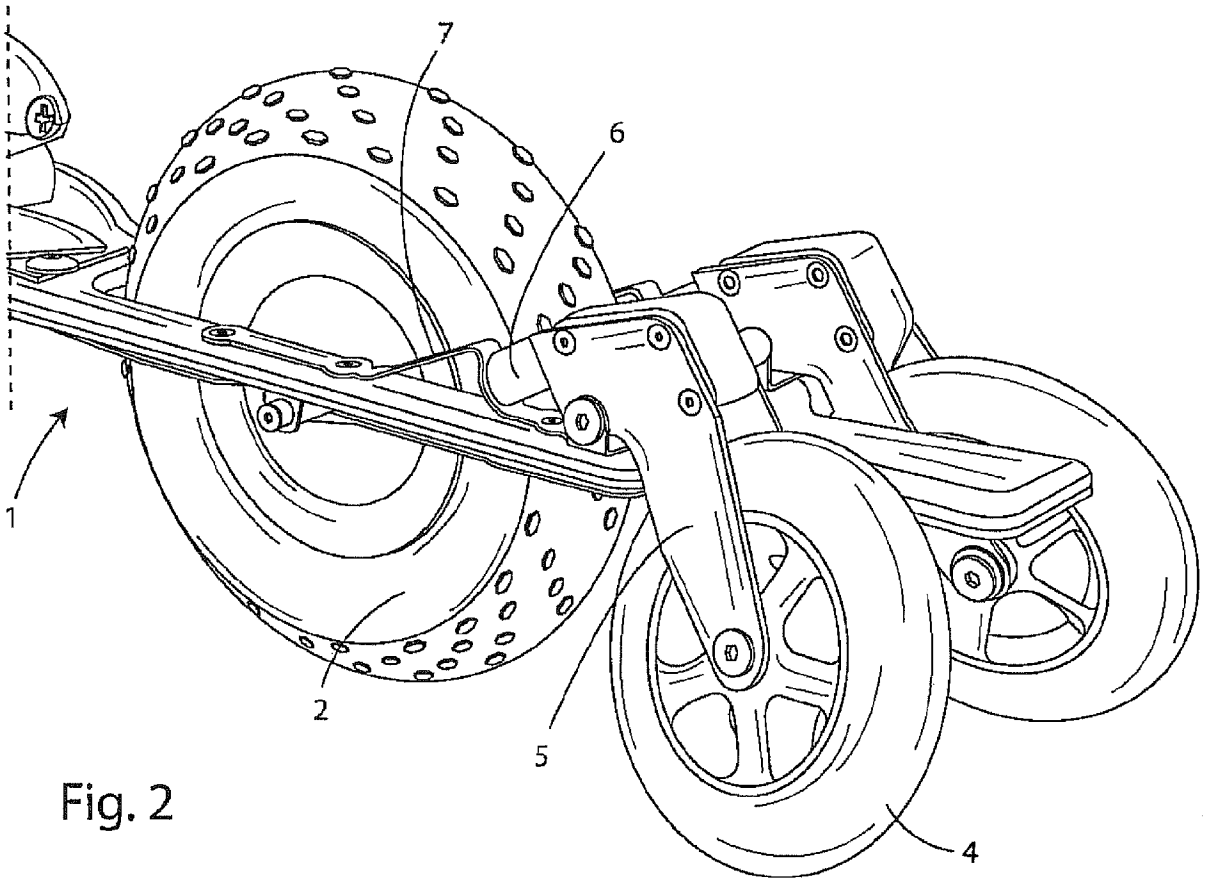
FIG. 2 is a perspective view of a roller ski showing the embodiment of the innovative solution according to the present invention shown in FIG. 1.
Figure 3:
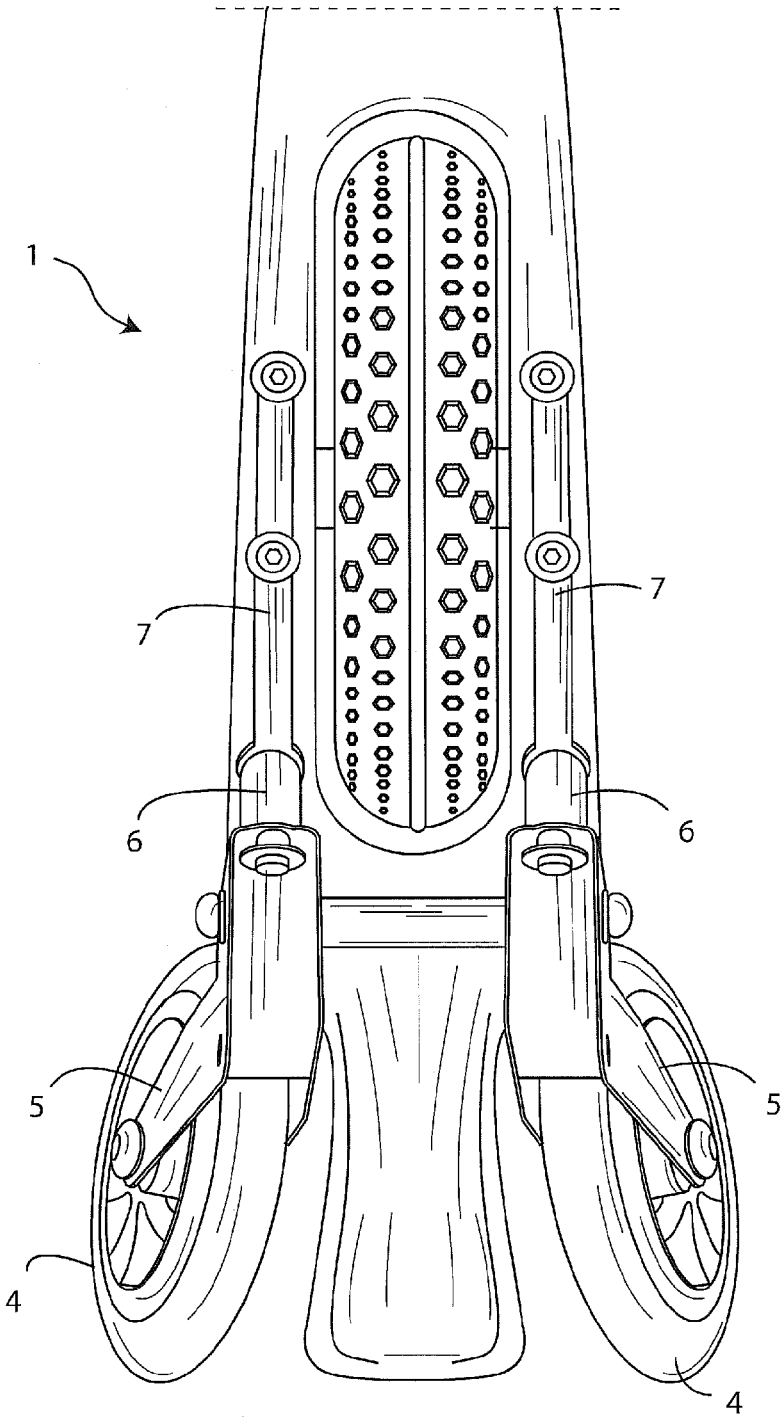
FIG. 3 is a top view of the particular of ski of FIG. 2.
Figure 4:
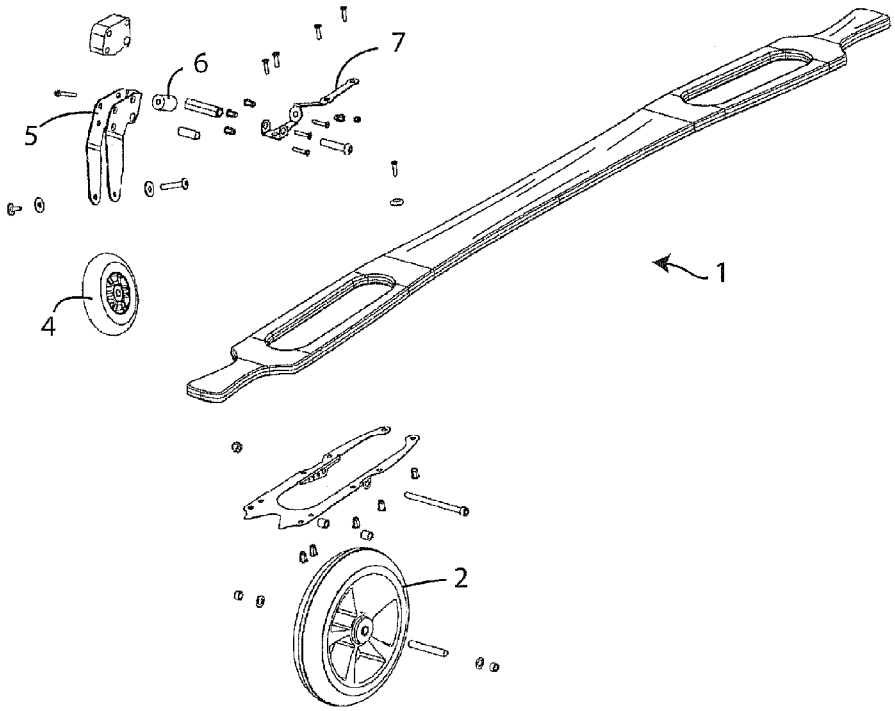
FIG. 4 is an exploded view of the innovative particular of ski of FIG. 2.
Figure 5:
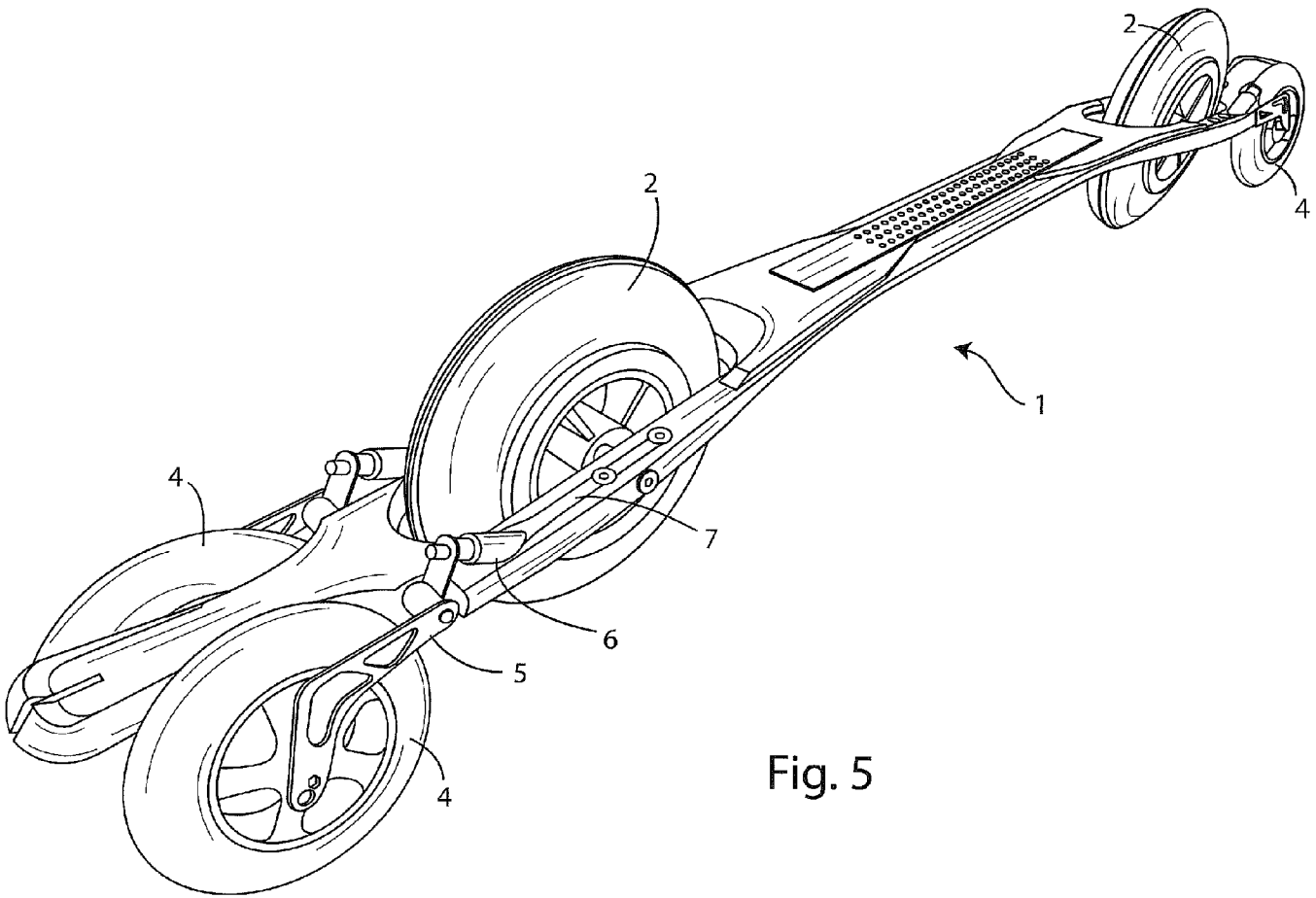
FIG. 5 is a perspective view of a second embodiment of a roller ski according to the invention.
Figure 6:
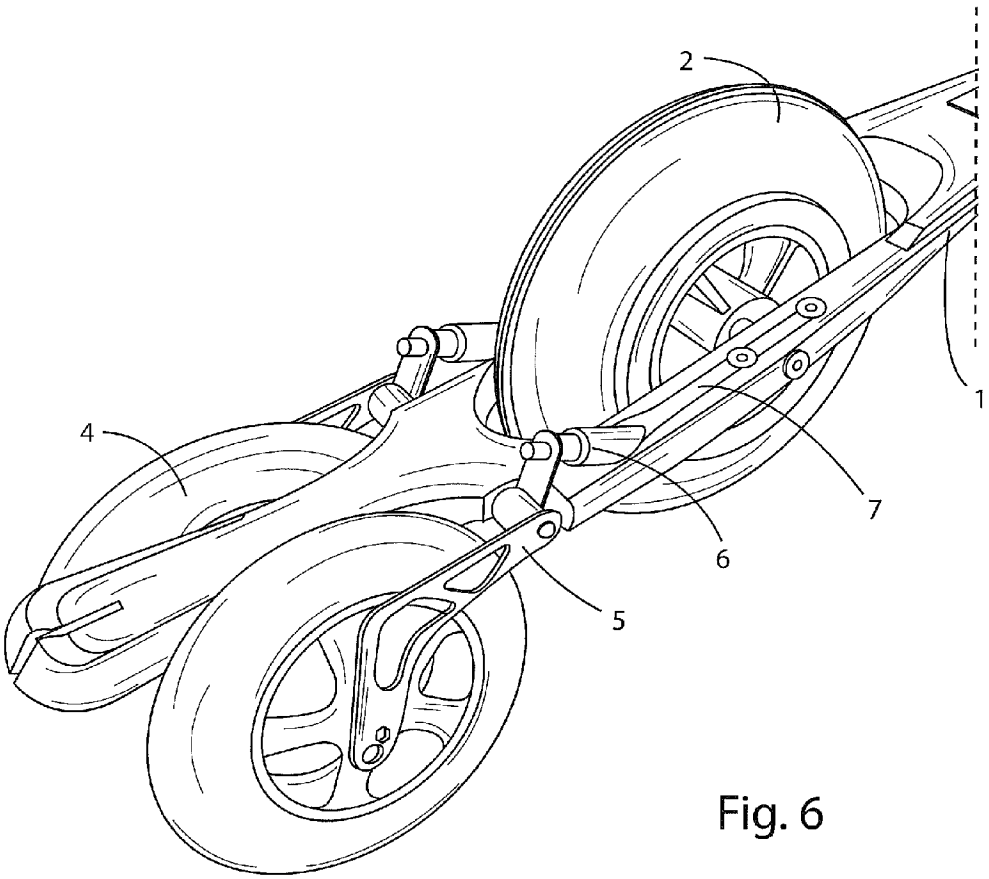
FIG. 6 shows innovative particular of ski of FIG. 5.
Figure 7:
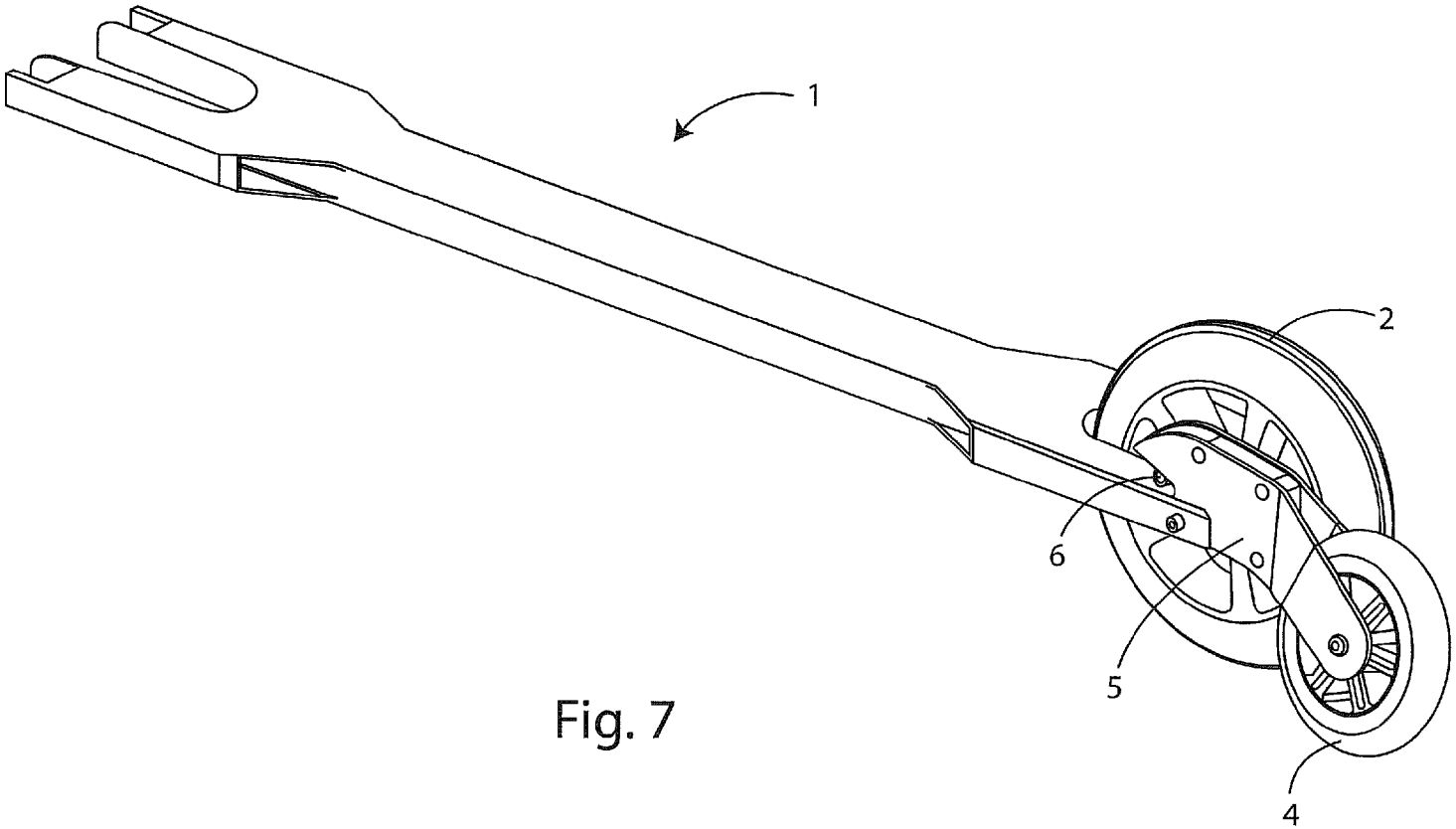
FIG. 7 is a perspective view of a particular of a ski according to a third embodiment according to the invention.
Figure 8:
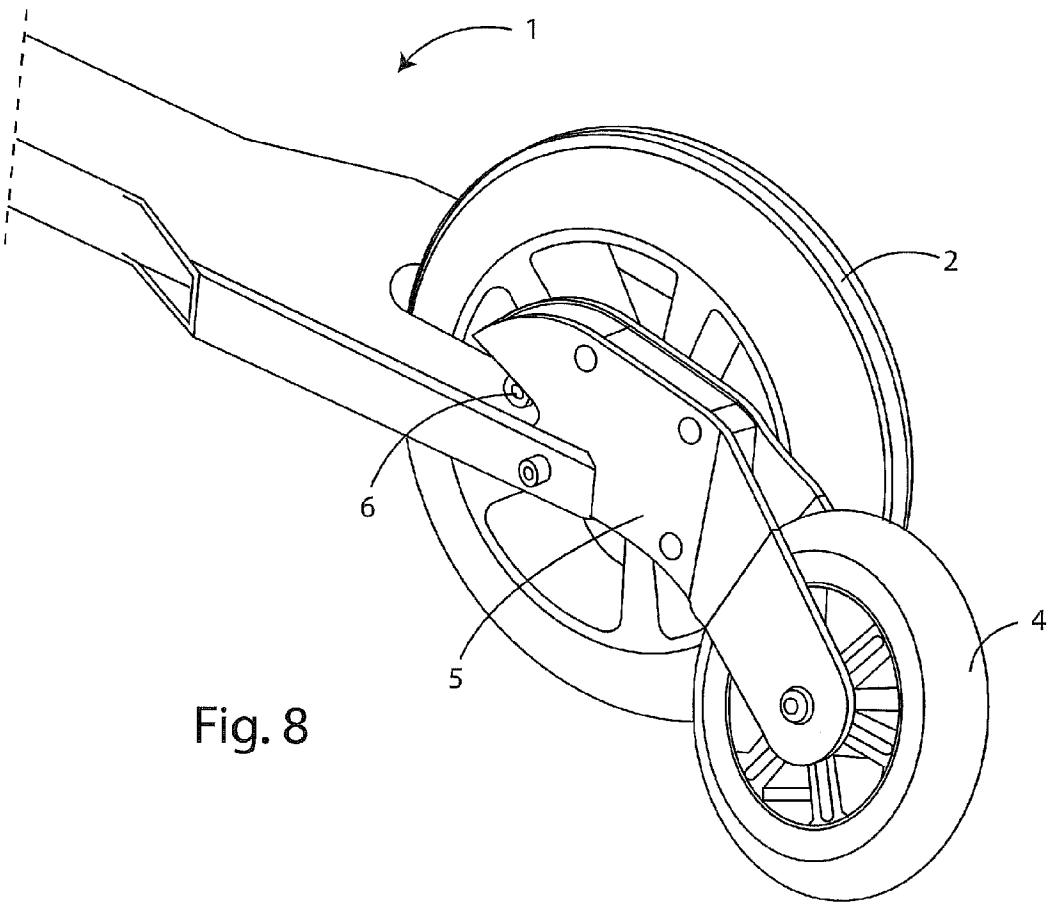
FIG. 8 shows a more detailed particular of ski of FIG. 7.
Figure 9:
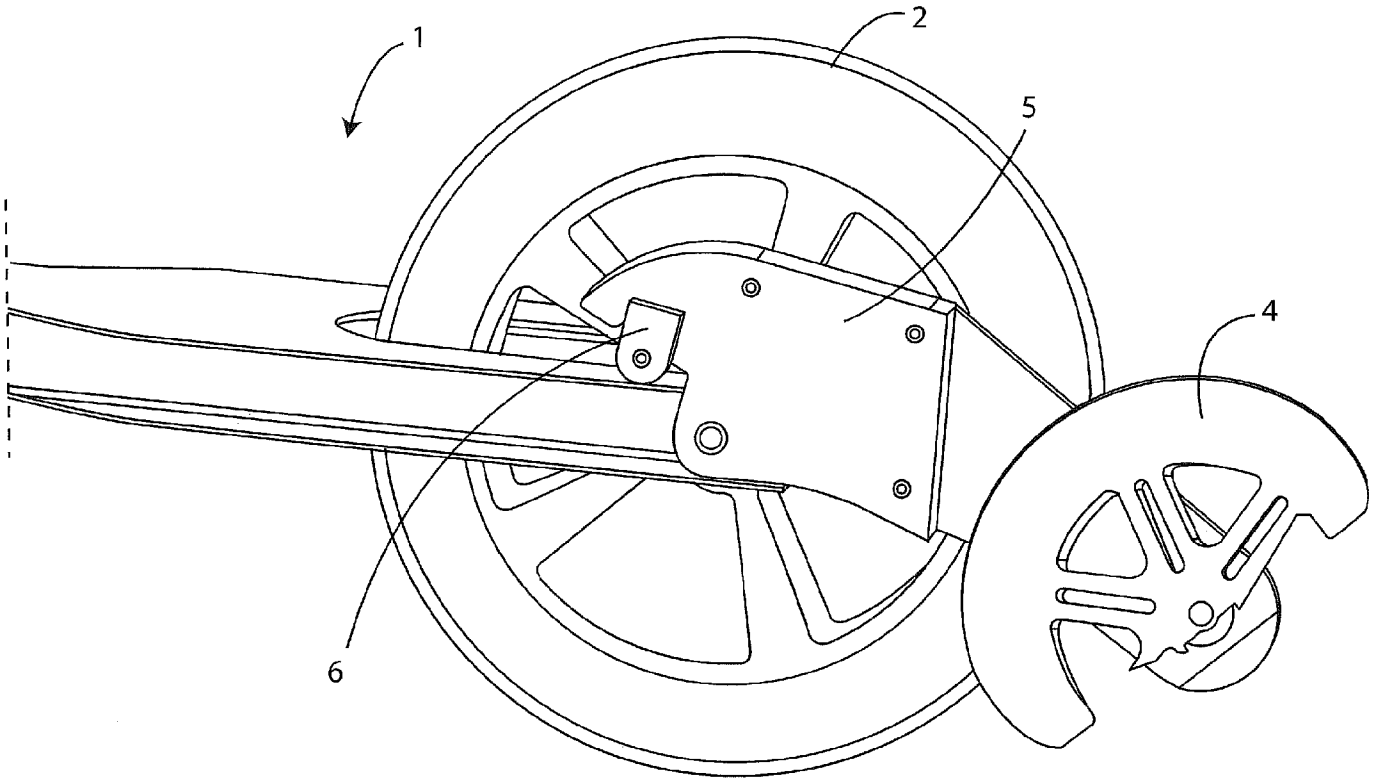
FIG. 9 is a lateral view of a particular of the embodiment of FIG. 7.
Figure 10:
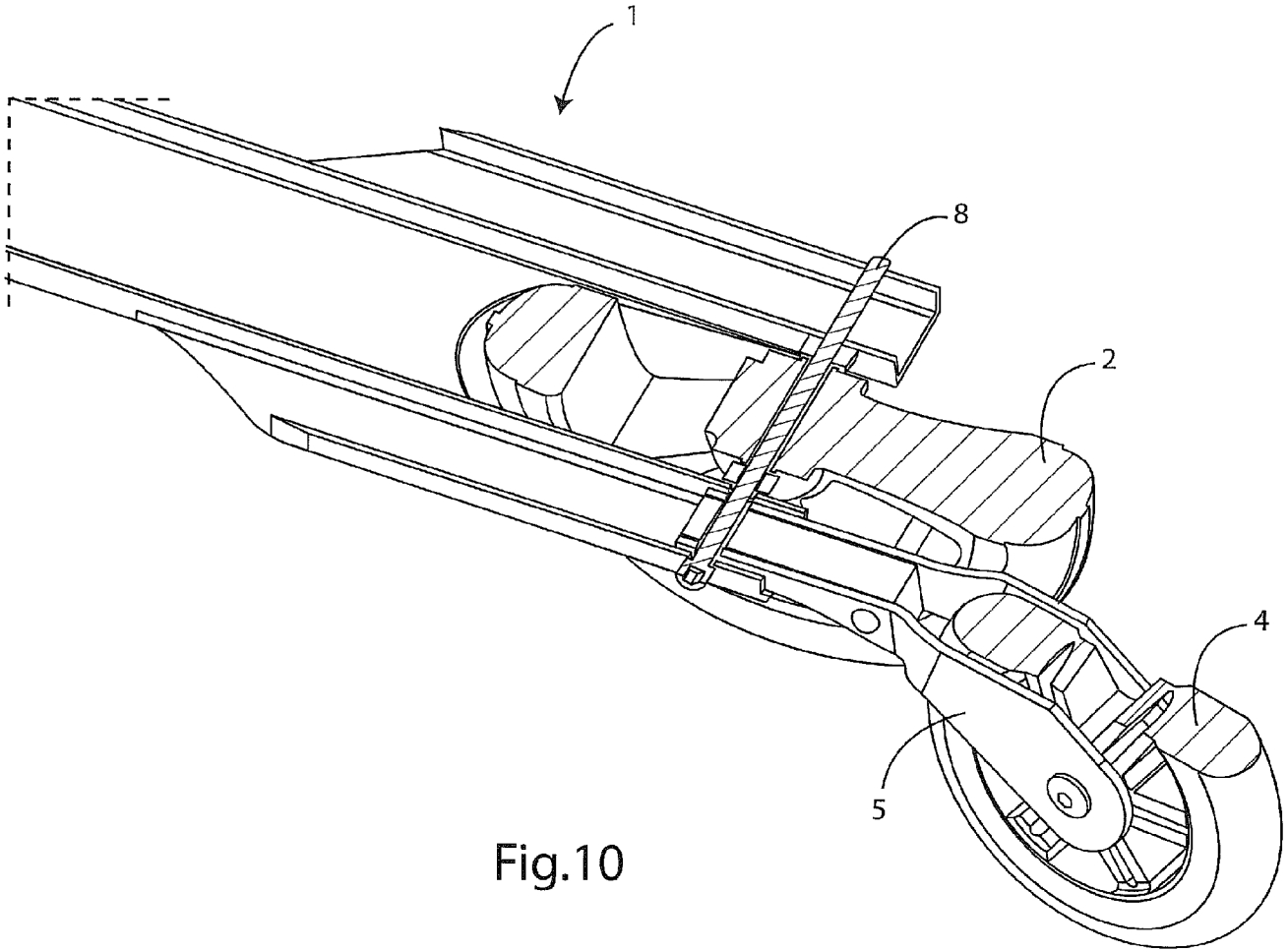
FIG. 10 is a perspective cut away view of a particular of the embodiment of FIG. 7.
Figure 11:
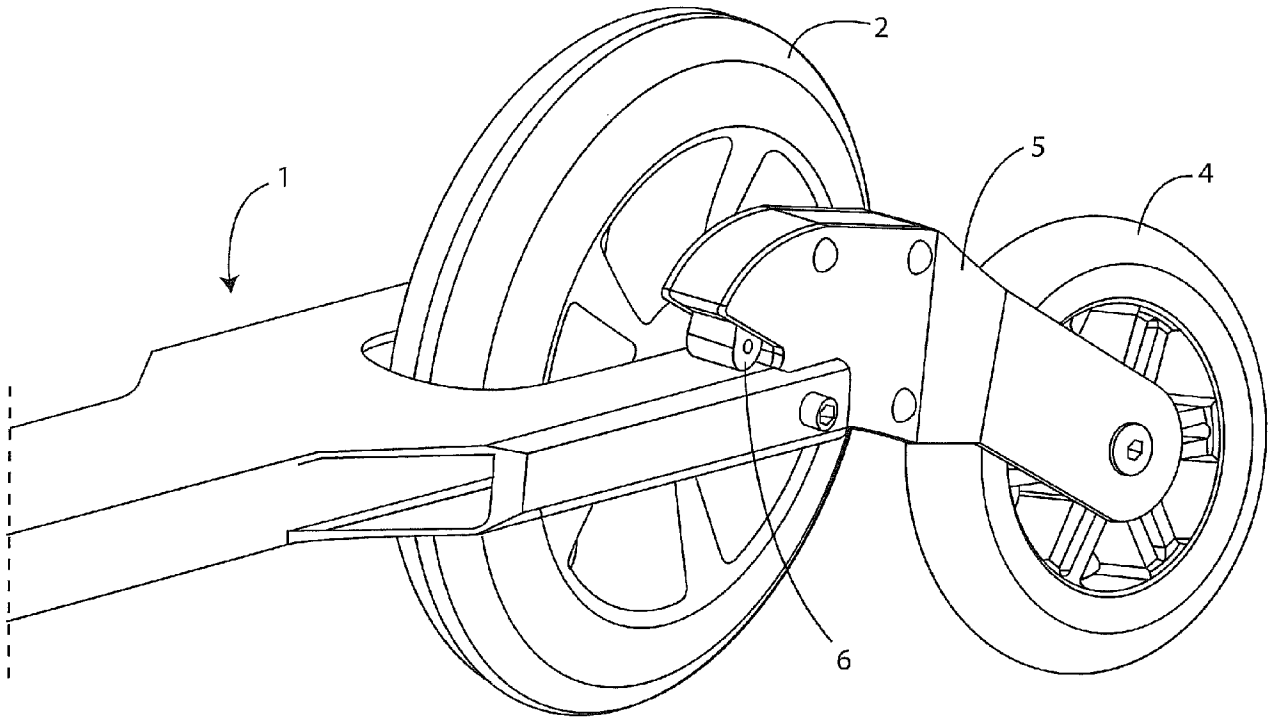
FIG. 11 is a further perspective view of a particular of the embodiment of FIG. 7.
Figure 12:
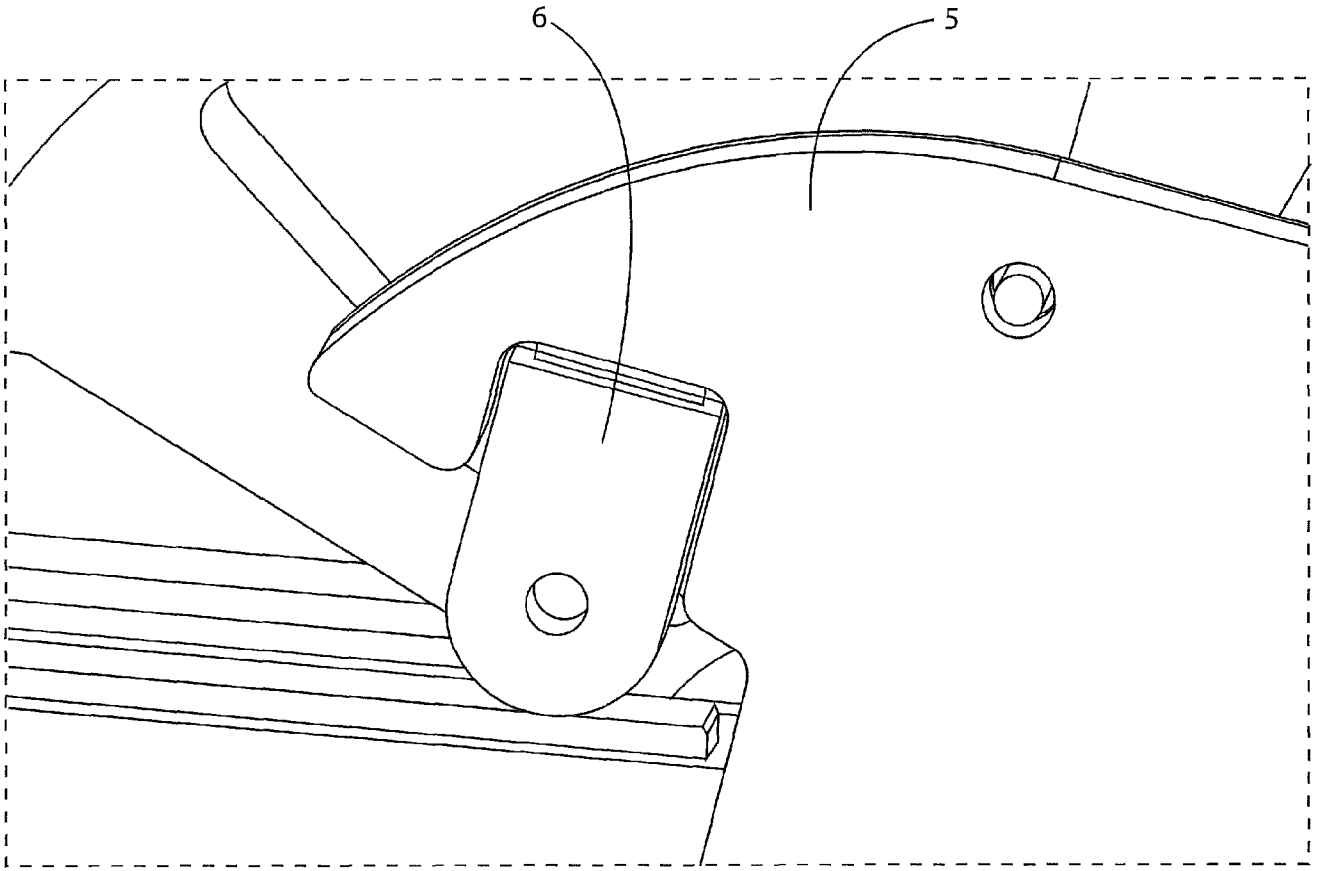
FIG. 12 is a lateral detailed view of embodiment of FIG. 7.

The specification will be addressed in the following to a ski, but the same can also be provided on a board.

Observing first FIGS. 1-4 of the enclosed drawings, it is shown a first embodiment of the solution according to the present invention.

Ski, generically indicated by reference number 1, provides two in-line rollers 2, a fitting system 3, for ski-shoes (not shown), and two pairs of additional rollers 4, respectively front rollers and rear rollers.

Each roller 4 is supported by a fork 5, coupled with ski 1 by interposition of an elastic element 6 and a sheets system 7. Particularly, it is observed in the figures that said forks 5 are inclined with respect to ski 1, and that resilient element 6 is an ideal prosecution of fork 5, while sheets system 7 is the joint between fork 5—resilient element 6 and fiat surface of ski 1.

Resilient element 6 can be comprised of rubber, spring, or any other resilient element.

System made up of sheets 7 and resilient element 6 can further provide means for adjusting hardness and inclination, permitting to the skier to adapt ski to his/her needing.

Coming now to describe the embodiment of FIGS. 7-12, the same reference numbers will be used to indicate parts corresponding to those of the previous embodiment.

Main object of this embodiment is that of further reducing the number of elements comprising the device, so as to simplify its structure, without limiting its efficiency and flexibility and conformability to the different applications.

In the embodiment shown, resilient element 6 is provided between fork 5 end faced toward the ski or board and the same ski or board. Such an arrangement can be particularly observed from FIGS. 9, 11 and 12. As it can be observed in FIG. 10, a transverse pin 8 is provided between the two forks 5 of each pair of additional rollers (only one of them is shown in FIGS. 7-12).

Replacement of elastomeric elements 6 permits adjusting hardness of dampening.

Figure 13:
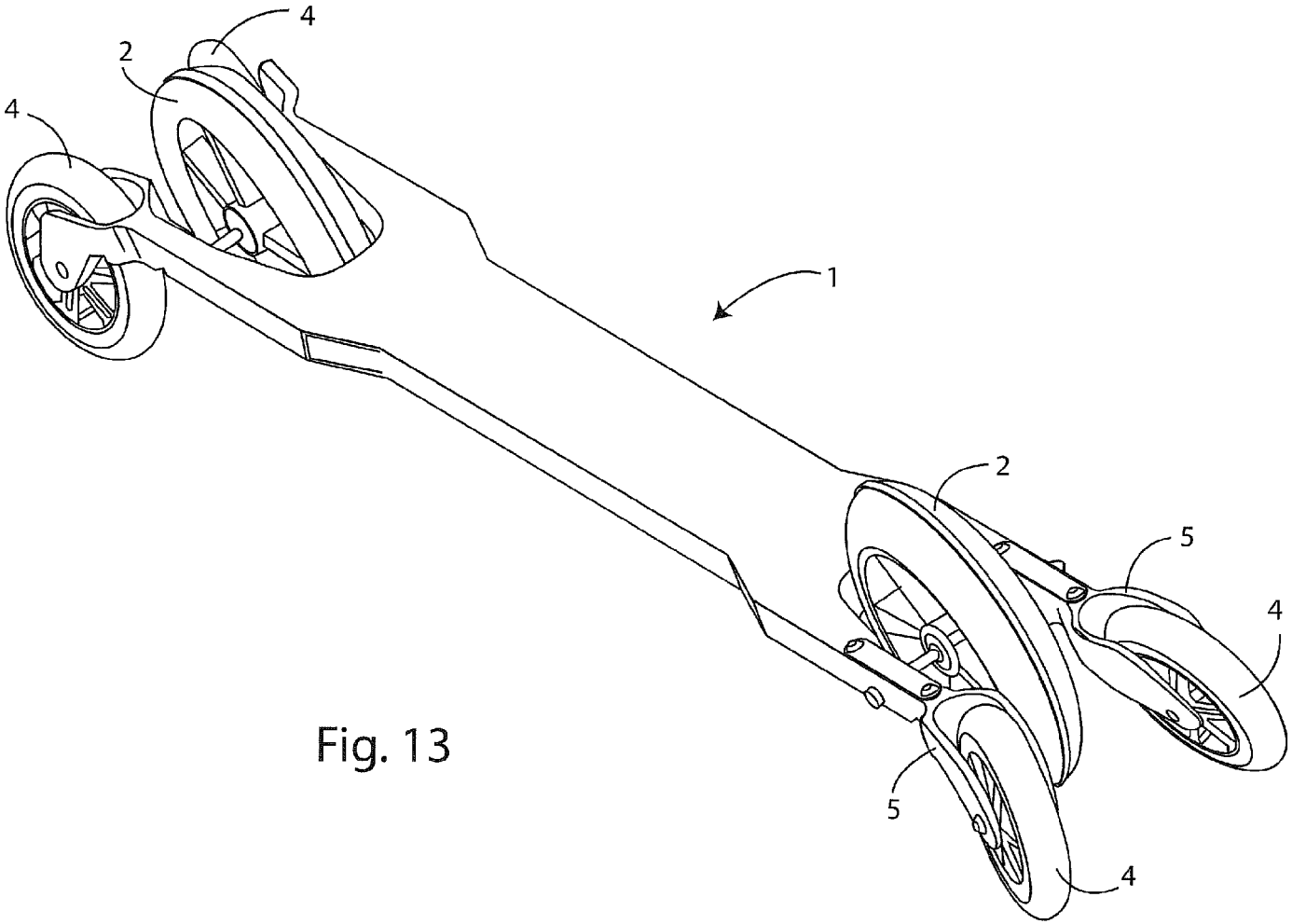
FIG. 13 is a perspective view of a fourth embodiment of the ski according to the invention.
Figure 14:
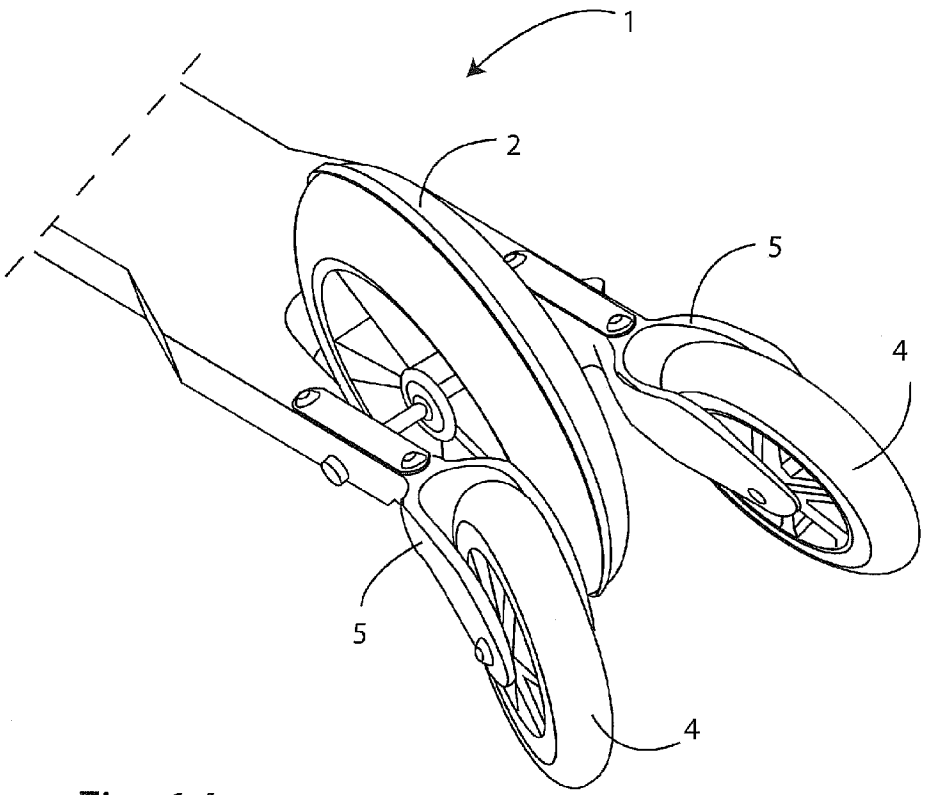
FIG. 14 is a perspective view of a particular of ski of FIG. 13.
Figure 15:
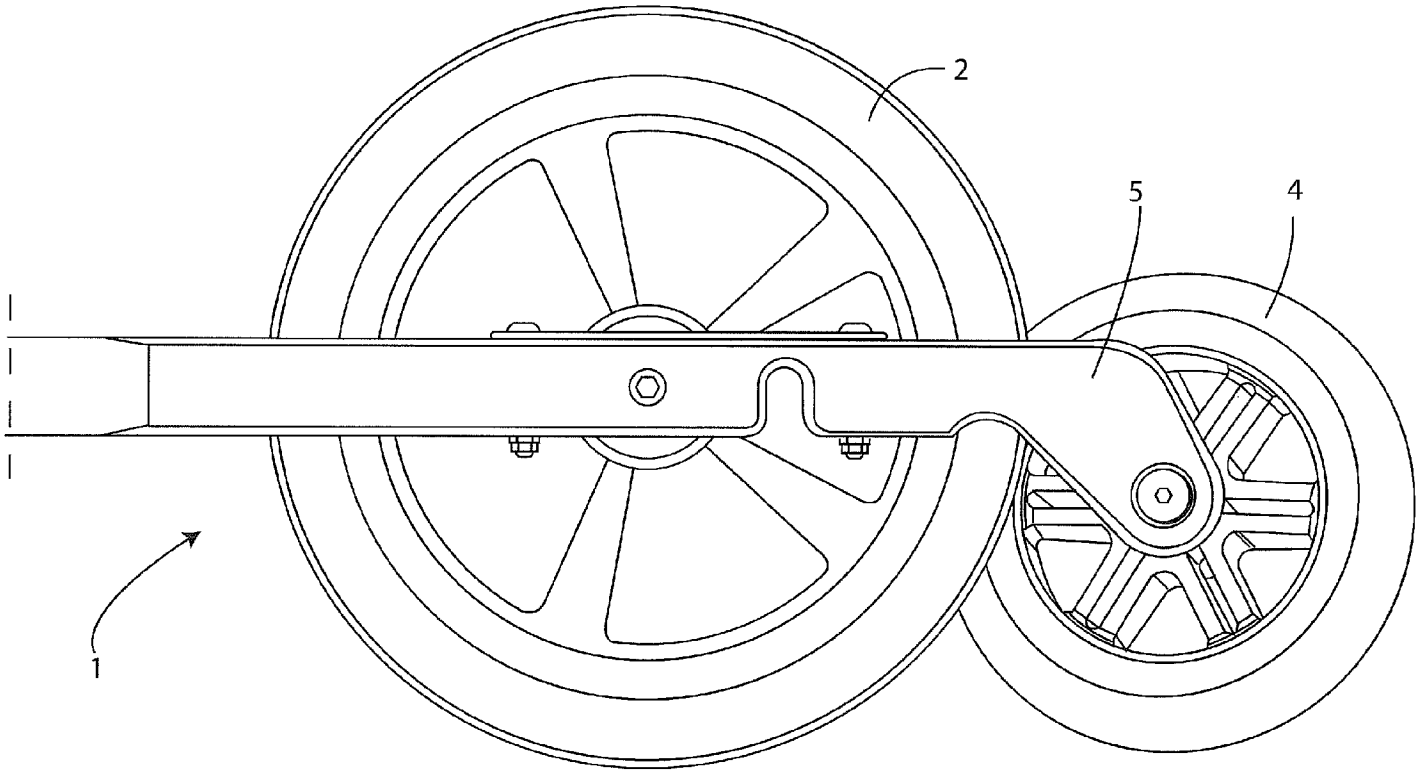
FIG. 15 is a lateral view of particular of FIG. 14.

Coming now to describe the embodiment shown n FIGS. 13-15, the same reference numbers will be used to indicate parts corresponding to those of the previous embodiments.

Solution shown in these figures is the simplest one, with the maximum reduction of components. In this case, ski 1 body and forks 5 are comprised of a single element, thus entrusting to the material making up forks 5 reaction to flexion and torsion stresses transmitted by rollers to the tool "frame".

In order to realize the above, fork 5 is clearly separated with respect to the body, but in the origin section, so that ski 1 has geometrically ends with a "U" shape both in the front portion and in the rear portion, thus creating four shelves, to which it is delegated to roller 4 dampening function.

Elastic/dampening behavior of said shelves depends on geometry and dimensions of fork 5 section, as well as on material by which it is realized.

Said fork can be comprised by a single material, with suitable resistance and elasticity characteristics, but more likely, it is realized by a composite material, i.e. comprised of different cooperating materials which, as a whole, making the specific tasks. An example of realization of the above can be a co-molded material comprising steel and plastics, wherein structural and resistance functions are made by metallic parts while the dampening functions are demanded to the plastic portion.

The above system permits obtaining the above advantages, permitting an optimum inclination of ski 1, perfectly simulating the action of skiing, regardless slope characteristics, speed, skier characteristics and its ability.

Present invention has been described for illustrative, but not imitative, purposes, according to its preferred embodiments, but it is to be understood that variations and/or modifications can be introduced by those skilled in the art without departing from the relevant scope as defined in the enclosed claims.

The invention claimed is:

1. A roller ski or board, said ski or board providing in-line central rollers that each rotate about an axis that is substantially co-planar with a roller ski or board body, and two pairs of additional rollers, respectively a front pair and a rear pair, said pairs of additional rollers being raised with respect to the ground on which said ski or board rests when the same ski or board is substantially parallel with respect to the ground, and contacting the same ground when ski or board is inclined, said ski or board being characterized in that each one of the additional rollers is coupled with the ski or board by a support system comprising a fork, having one end coupled with the roller and the other one coupled to the ski or board as an extension of the ski or board in a direction of a longitudinal axis of the ski or board, and wherein between the end of the fork faced toward the ski or board and the same ski or board being provided a resilient element.

2. The roller ski or board according to claim 1, wherein said system further includes a sheets system for fixing said resilient element on the ski or board.

3. Roller ski or board according to claim 1, characterized in that ski or board and forks are realized integrally in a single piece, said resilient element being comprised of a specific material provided in the joining portion between ski or board and forks.

4. The roller ski or board according to claim 1, wherein said resilient element is comprised of a rubber element, of an elastomeric element, or of a spring.

5. The roller ski or board according to claim 1, wherein said resilient element is coupled to the ski or board via a shaped sheet so as to operate as a joint between the flat surface of the roller ski or board and a coupling angle of the fork.

6. The roller ski or board according to claim 1, wherein each said additional roller is pivotable about an axis that is substantially transverse to the direction of the longitudinal axis of the roller ski or board.

7. The roller ski or board according to claim 2, wherein said sheets system extends in a longitudinal direction that is parallel with the longitudinal axis of the roller ski or board.

8. The roller ski or board as claimed in claim 1, wherein said in-line central rollers are positioned between the two pairs of additional rollers.

* * * * *